US005887788A

United States Patent [19]

Wakui et al.

[11] Patent Number: 5,887,788

[45] Date of Patent: Mar. 30, 1999

[54] STEEL PIPE CONNECTOR OF LADDER-TYPE SLEEPER FOR RAILWAY TRACK

[75] Inventors: Hajime Wakui, Kokubunji; Hiromi Inoue, Chofu; Yoshitaka Soga, Wakayama; Saburo Inoue, Osaka, all of Japan

[73] Assignees: Railway Technical Research Institute, Tokyo; Sumitomo Metal Industries, Ltd., Osaka, both of Japan

[21] Appl. No.: 837,868

[22] Filed: Apr. 25, 1997

[51] Int. Cl.[6] ..... E01B 3/00

[52] U.S. Cl. ..... 238/81; 238/117; 238/25; 238/54; 238/50; 238/70

[58] Field of Search ..... 238/24, 25, 50, 238/70, 71, 72, 81, 115, 116, 117, 54; 52/698

[56] References Cited

U.S. PATENT DOCUMENTS

| | | | |
|---|---|---|---|
| 291,514 | 1/1884 | Holbrook | 238/81 |
| 681,508 | 8/1901 | Raby | 238/81 |
| 3,371,866 | 3/1968 | Sonneville | 238/115 |
| 3,948,010 | 4/1976 | Sonneville | 238/115 |
| 5,464,153 | 11/1995 | Broughton | 238/117 |
| 5,582,346 | 12/1996 | Wakui et al. . | |

FOREIGN PATENT DOCUMENTS

| | | | |
|---|---|---|---|
| 2571394 | 4/1986 | France | 238/117 |

*Primary Examiner*—Mark Tuan Le

*Attorney, Agent, or Firm*—Watson Cole Grindle Watson, P.L.L.C.

[57] ABSTRACT

To provide inexpensively a connector constructed of a steel pipe and bearing a tie function of a ladder-type sleeper for railway tracks, in a connector constructed of a steel pipe 1 used in the ladder-type sleeper for railway tracks integrated with longitudinal beams made of concrete and the connectors constructed of steel pipes 1 by feeding concrete, both end portions of the connector constructed of the steel pipe 1 are flattened in the horizontal direction and a corrosion resistant coating 4 is coated at portions of the connector constructed of the steel pipe 1 exposed to the atmosphere.

9 Claims, 4 Drawing Sheets

STEEL PIPE CONNECTOR OF LADDER-TYPE SLEEPER FOR RAILWAY TRACK

BACKGROUND OF THE INVENTION

1. Field of the Invention

The present invention relates to a connector constructed of a steel pipe which is used in a sleeper of a mixed rigid connection structure having a ladder-like shape (hereinafter, referred to as a ladder-type sleeper for railway tracks) that is integrated with longitudinal beams made of concrete and connectors constructed of steel pipes as a railway track laid on a bed of a railroad.

2. Description of Related Art

A railroad is an exclusive road constructed of a track and a base supporting the track. A railway track includes a bed, sleepers and rails and the base includes a road base supporting the bed and a railway structure. A ballast is generally used for the bed and impact force or vibration by a train are absorbed by its elasticity. As a railroad of a super-express train, a slab track where the sleepers and the ballast are replaced by concrete and mortar is used for alleviating track maintenance. There are three roles of the sleeper, that is, a sleeper function for alleviating a load applied on the bed by distributing the weight of train widely over the bed and preventing rails from causing aged sinking, a tie function of maintaining constant an interval (rail gauge) between left and right rails and a lateral resistant and longitudinal resistant function to make rails immovable in the left and right direction and in the forward and rearward direction against the operation of a lateral pressure and a force in the direction of the axes of the rails.

It is said that the total number of sleepers used in railroads in the world amounts to three billion pieces, among which four hundred million pieces are sleepers made of concrete. Sleepers made of wood currently share an overwhelmingly high proportion as indicated by the Chinese ideograph for "pillow wood". However, the use of sleepers made of wood which gives rise to exhaustion of forest resources tends to be restricted year by year in view of environmental conservation, among all preservation of forest resources. Therefore, an enormous worldwide demand is estimated in the future for sleepers made of concrete so as to contribute to environmental conservation, and a further expectation is put therefor. Approximately twenty million pieces per year of sleepers made of concrete are produced as a substitute for sleepers made of wood, as well as sleepers for new line construction. Especially in advanced countries with railroads such as Europe, Japan and the like, approximately one half the yearly demand for sleepers includes sleepers made of concrete.

As illustrated by FIG. 3, according to a sleeper track of a conventional railroad, sleepers 32 are arranged orthogonally to the axial direction of two rails 31*a* and 31*b* at predetermined intervals (for example, about 750 mm). A sleeper made of wood or a sleeper made of concrete is used for the sleeper 32. According to the sleeper track, the sleepers constitute bases placed independently from each other for intermittently supporting the rails and accordingly, they support rails only partially. Therefore, every time a train passes through portions of the rails which are not brought into contact with the sleepers vibration occurs and a noise referred to as "rolling sound" is caused. Further, in respect of a track where a ballast is laid on a bed, warp of the rails is liable to occur by repeated application of the weight of the train, which gives rise to rocking of a running train. An increase in the rocking of a running train accelerates deterioration of the track.

Meanwhile, the formation of the sleepers made of concrete has progressed along with long welded rails a means for acceleration and comfortability of transportation. A large temperature dependent axial compression force (a force stored at the inside of rails for fixing unmovably the rails by sleepers against elongation and contraction of the rails by the change in temperature) is operated on the rails with the formation of long welded rails and therefore, rails are bent in the upper and down direction and in the left and right direction when the fixing force is weak. In order to prevent the deformation of the rails, sleepers made of concrete which have a large weight and a large rail fastening force becomes an important track component factor exceeding a role of a substitute for sleepers made of wood in the present age high speed railroad.

Although as described above sleepers made of concrete constitute an important track component factor exceeding the role of the substitute for sleepers made of wood in the present age high speed railroad, the configuration thereof is quite equal to that of the sleepers made of wood whereby achievement of labor saving in maintenance of ballasted tracks is limited. Especially, enormous cost and labor are necessary in the maintenance of ballasted tracks, however, the maintenance operation is referred to as a representative of the so called "3K operations" in Japan (dangerous, laborious and dirty operation) as a result of limiting the operational maintenance time to the middle of the night with respect to the operational time of the railroad and is an operation avoid by young people.

Recently, a ladder-type sleeper was disclosed in "RRR", 1995. 12, p8–28, issued by a foundation of the Railway Technical Research Institute for reducing the maintenance on ballasted track. Specific structure and feature of the ladder-type sleepers for railway tracks will be explained in reference to FIG. 4 and FIG. 5. In respect of longitudinal beams 41 bearing the sleeper function, there is adopted a pretension type prestressed reinforced concrete structure (hereinafter, referred to as a pretension type PRC structure) where upper and lower prestressing strands 42 are pretensioned and the tension force is released after curing a fed concrete 43 and the longitudinal beams 41 having the pretension type PRC structure are designed by a limited design method whereby a necessary and sufficient load bearing function can be ensured even with a least sectional area under conditions of a ballasted bed where a disadvantageous support state must be predicted. With respect to connectors bearing the tie function, small diameter thick wall steel pipes 44 having a rigidity necessary for holding the rail gauge, are arranged at intervals of 3.0 m, embedded portions 45 of the small diameter thick wall steel pipes 44 are inserted between the upper and lower prestressing strands 42 which constitute main axial reinforcement members of the longitudinal beams 41 and which are under tension and a mixed rigid connection structure having a ladder-like shape is formed by integrating the connectors solidly with the longitudinal beams 41 by feeding concrete 43 whereby the tie function is sufficiently ensured. Incidentally, numeral 46 in the drawings designates a star lap, numeral 47 designates an embedding metal piece, numeral 48 designates a rail and numeral 49 designates a rail fastener.

With respect to the small diameter thick wall steel pipe bearing the tie function of the ladder-type sleeper for railway tracks, a carbon steel pipe for general structure STK 540 prescribed in JIS (Japanese Industrial Standards) G3444 is used in view both of rigidity and operational performance and in view of cost and ribs 51 are fixedly welded to both end portions of the small diameter thick wall steel pipe 44 as shown by FIG. 6. Also, portions of the small diameter thick wall steel pipe 44 exposed to the atmosphere are coated with a rubber lining 52 by a curing treatment for preventing corrosion since waterproof, stray current resistance (insulation performance), impact resistance and weather resistance are necessary for these portions in view of environments where they are used.

With respect to the installation of the ribs onto the small diameter thick wall steel pipe bearing the tie function of the ladder-type sleeper for railway tracks, working steps of rib working, rib welding and the like are necessary, which poses a significant problem for the ladder-type sleepers for railway tracks in view of a further reduction in cost and achievement of mass production. Also, the execution of the rubber lining by a curing treatment for preventing corrosion poses a problem of necessitating the curing treatment cost since the small diameter thick wall steel pipes are needed to transport to a rubber lining executing company where a baking is executed.

SUMMARY OF THE INVENTION

It is an object of the present invention to provide a connector constructed of a steel pipe of a ladder-type sleeper for railway tracks capable of resolving the drawbacks of small diameter thick wall steel pipes bearing the tie function of the ladder-type sleeper for railway tracks, dispensing with the installation of ribs to the small diameter thick wall steel pipes and providing corrosion resistance more inexpensively than in the execution of the rubber lining whereby the requirement of reduction in cost and achievement of mass production can be met.

The inventors have carried out an intensive test and study in order to achieve the above-described object. As a result, they have reached the present invention by clarifying that a rotation preventive and drawing preventive function could be provided by flattening both end portions of the connector constructed of a steel pipe in the horizontal direction without installing ribs at side faces of the both end portions of the connector constructed of a steel pipe bearing the tie function of the ladder-type sleeper for railway tracks, and further, the corrosion resistance could be attained inexpensively than in the baking operation of a rubber lining by coating a corrosion resistant coating at portions of the connector constructed of a steel pipe exposed to the atmosphere and fitting a rubber ring on the outer periphery whereby the cost reduction and the mass production can be achieved.

According to a first aspect of a connector constructed of a steel pipe of a ladder-type sleeper for railway tracks, both end portions of the connector constructed of a steel pipe are flattened in the horizontal direction. A rotation preventive and drawing preventive function can be attained without fixedly welding ribs at side faces of the both end portions by flattening in the horizontal direction the both end portions of the connector constructed of a steel pipe in this way. In respect of the flattening operation of the both end portions of the pipe in this case, an amount of working can be specified to a range of from a flattened amount of ⅛ of the outer diameter of the connector constructed of a steel pipe to an amount thereof whereby the inner faces are brought into close contact, depending on materials. Incidentally, the bending strength of the connector constructed of a steel pipe can be enhanced by filling concrete at the inside of the connector constructed of a steel pipe.

According to another aspect of the present invention, there is provided a connector made of a steel pipe of a ladder-type sleeper for railway tracks where the both end portions of the connector constructed of a steel pipe are flattened in the horizontal direction and a corrosion resistant coating is coated on portions of the connector constructed of a steel pipe exposed to the atmosphere. In this way, a rotation preventive and drawing preventive function can be attained by flattening both end portions of the connector constructed of a steel without fixedly welding ribs on side faces of the both end portions. Also, by coating a corrosion resistant coating at portions of the connector constructed of a steel pipe exposed to the atmosphere, corrosion resistance and stray current resistance can be achieved more inexpensively than in a rubber lining by a curing treatment. A polyolefin coating, an epoxy coating, a polyurethane coating, a zinc plating (a galvanized coating), an aluminum plating (an aluminum coating), a zinc-aluminum coating or a rubber coating is executed as the corrosion resistant coating. Furthermore, by fitting a rubber ring excellent in the weather resistance and the impact resistance onto the outer periphery of the corrosion resistant coating, the waterproof, the stray current resistance, the impact resistance and the weather resistance can be achieved more inexpensively than in the rubber lining by a curing treatment.

DETAILED DESCRIPTION OF THE PREFERRED EMBODIMENT

Figure 1:
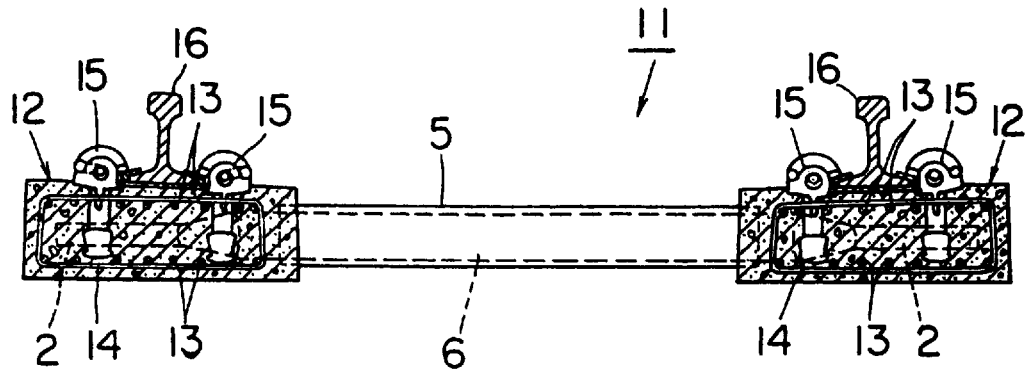
FIG. 1 is a sectional structural view of a ladder-type sleeper for railway tracks using a connector constructed of a steel pipe according to the present invention.

According to the flattening operation of both end portions of a connector constructed of a steel pipe of the present invention, a steel pipe coated with a corrosion resistant coating is cut into a predetermined dimension of a connector, a rubber ring is fitted at portions of the connector constructed of a steel pipe exposed to the atmosphere and thereafter, the both end portions of the pipe are flattened in the horizontal direction. Although no limitation is particularly imposed on the method of flattening, it is preferred that the flattening operation be executed by pressing. Further, with respect to the amount of flattening of the both end portions of the connector constructed of a steel pipe, the flattening is executed until a thickness of the flattened portion falls in a range of ⅛ of the outer diameter to an amount whereby the inner faces are brought into close contact with each other. The sufficient rotation preventive and drawing preventive function cannot be achieved with the flattened thickness, the amount of which does not reach ⅞ of the outer diameter.

Although cracks are not caused even if the flattening with the inner faces of the pipe in close contact with each other, depending on materials, it is preferable that the flattening is executed such that the amount of flattened thickness reaches ⅔ through ½ of the outer diameter in consideration of filling of concrete to the inside of the connector constructed of a steel pipe. Further, in respect of the lengthwise dimension of the flattened portions from both ends, it was confirmed that the sufficient rotation preventive and drawing preventive function could be achieved with the dimension of 50 mm or more and therefore, portions of the connector disposed at the inside of the longitudinal beams are flattened by 50 mm or more.

In respect of filling concrete to the inside of the connector constructed of a steel pipe, after flattening the both end portions of the connector constructed of a steel pipe, concrete is filled from one of the end portions of the pipe and is made to solidify. The connectors constructed of steel pipes are inserted between the prestressing strands which constitute the main axial reinforcement steel members of the longitudinal beams and are rigidly integrated with the longitudinal beams by feeding concrete by which the mixed rigid connection structure in a ladder-like shape is formed whereby the tie function can sufficiently be ensured. Incidentally, in the flattening operation of the both end portions of the connector constructed of a steel pipe, the pipe is flattened in the horizontal direction because if it is flattened in the vertical direction, the insertion of the pipe between the prestressing strands which are the main reinforcement steel materials of the longitudinal beams, is hindered.

With respect to the polyolefin coating material for a corrosion resistant coating coated at portions of the connector constructed of a steel pipe exposed to the atmosphere according to the present invention, there are polyethylene (low through high density), polypropylene, polybutene and polystyrene and polyethylene is excellent in view of the cost and the corrosion resistant function. For example, with respect to the polyethylene coating, an inexpensive inorganic synthetic pigment such as carbon black or the like may be added thereto by 0.5 through 3.0 weight % within a range where the physical property of polyethylene per se is not deteriorated. In the polyethylene coating, an asphalt synthetic group pressure sensitive adhesive and a polyethylene group adhesive agent, modified polyethylene and ethylene-vinyl acetate copolymer or the like may be interposed between the steel pipe and polyethylene as an adhesive agent.

The connector constructed of a steel pipe is coated with, for example, a polyethylene coating as a corrosion resistant coating over the entire length of the steel pipe and thereafter, cut into a predetermined dimension of a connector and the coated polyethylene film at the both end portions of the pipe needs to be removed before flattening the both end portions in order to promote the adhesion strength of the both end portions of the pipe in respect of concrete of the longitudinal beams. When the above necessity is considered, it is preferable to adopt a coating system where after subjecting the steel pipe to a chromate treatment (total amount of chrome adhesion; 100 through 1000 g/m$^2$), an epoxy group primer is coated (thickness; 10 through 100 $\mu$m), modified polyethylene or an adhesive agent of ethylene-vinyl acetate copolymer is coated (thickness; 50 through 300 $\mu$m) and polyethylene is coated (thickness; 0.6 through 3.0 mm). Also a rubber coating inclusive of carbon black or the like is coated by approximately several millimeters in consideration of the corrosion resistance and the weather resistance. Further, with respect to a zinc plating (a galvanized coating), an aluminum plating (an aluminum coating), a zinc-aluminum plating (a zinc-aluminum coating), the pipe is dipped in a plating tank whereby the plating is executed before flattening the both end portions in the horizontal direction whereby the mass production can be realized without requiring time and labor.

(Embodiment)

Embodiment 1

An explanation will be given of details of a connector constructed of a steel pipe of a ladder-type sleeper for railway tracks according to the present invention in reference to FIG. 1 and FIG. 2 as follows. FIG. 1 is a sectional structural view of a ladder-type sleeper for railway tracks using a connector constructed of a steel pipe in accordance with the present invention and FIGS. 2(*a*) and 2(*b*) illustrate the connector constructed of a steel pipe of the present invention where FIG. 2(*a*) is a plane view omitting a portion of a central portion thereof and FIG. 2(*b*) is a front view of the connector constructed of a steel pipe according to the present invention.

Figure 2A:
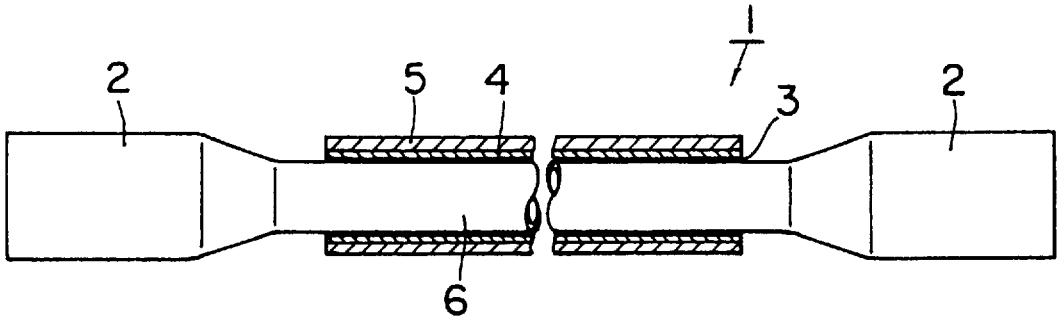
FIGS. 2(*a*) and 2(*b*) illustrate the connector constructed of a steel pipe according to the present invention where FIG. 2(*a*) is a plane view omitting a portion of a central portion thereof and FIG. 2(*b*) is a front view of the connector constructed of a pipe according to the present invention.
Figure 2B:
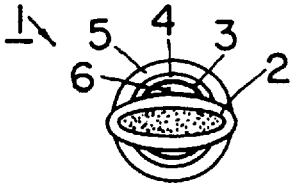
Figure 3:
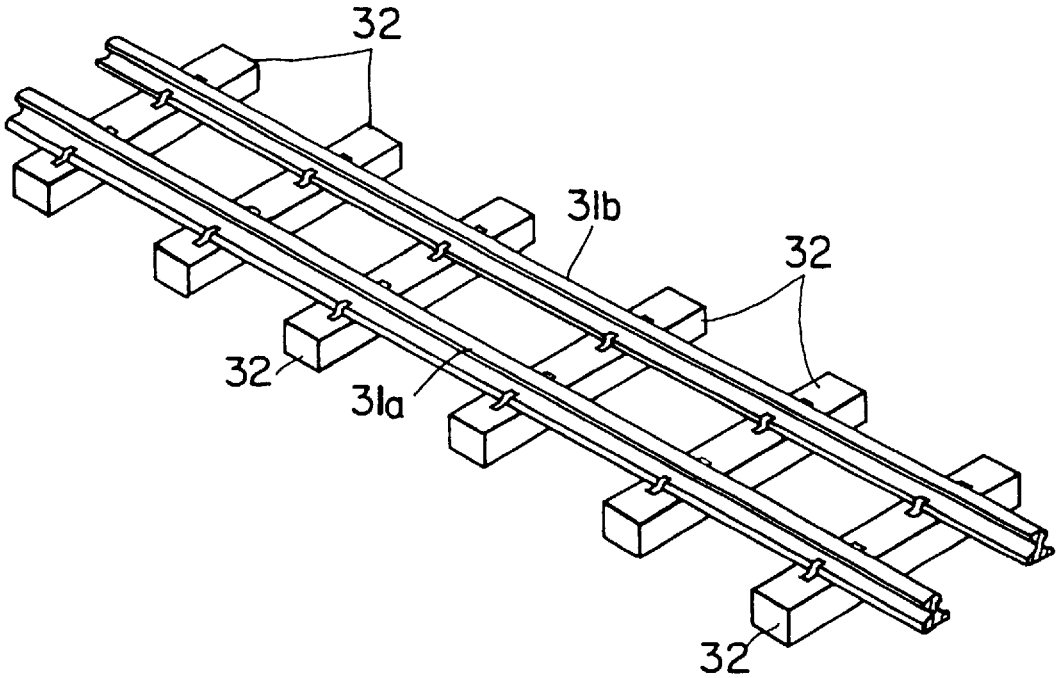
Fig. 3 (PRIOR ART)
FIG. 3 is a perspective view in which conventional sleepers are arranged in a direction orthogonal to rails.
Figure 4:
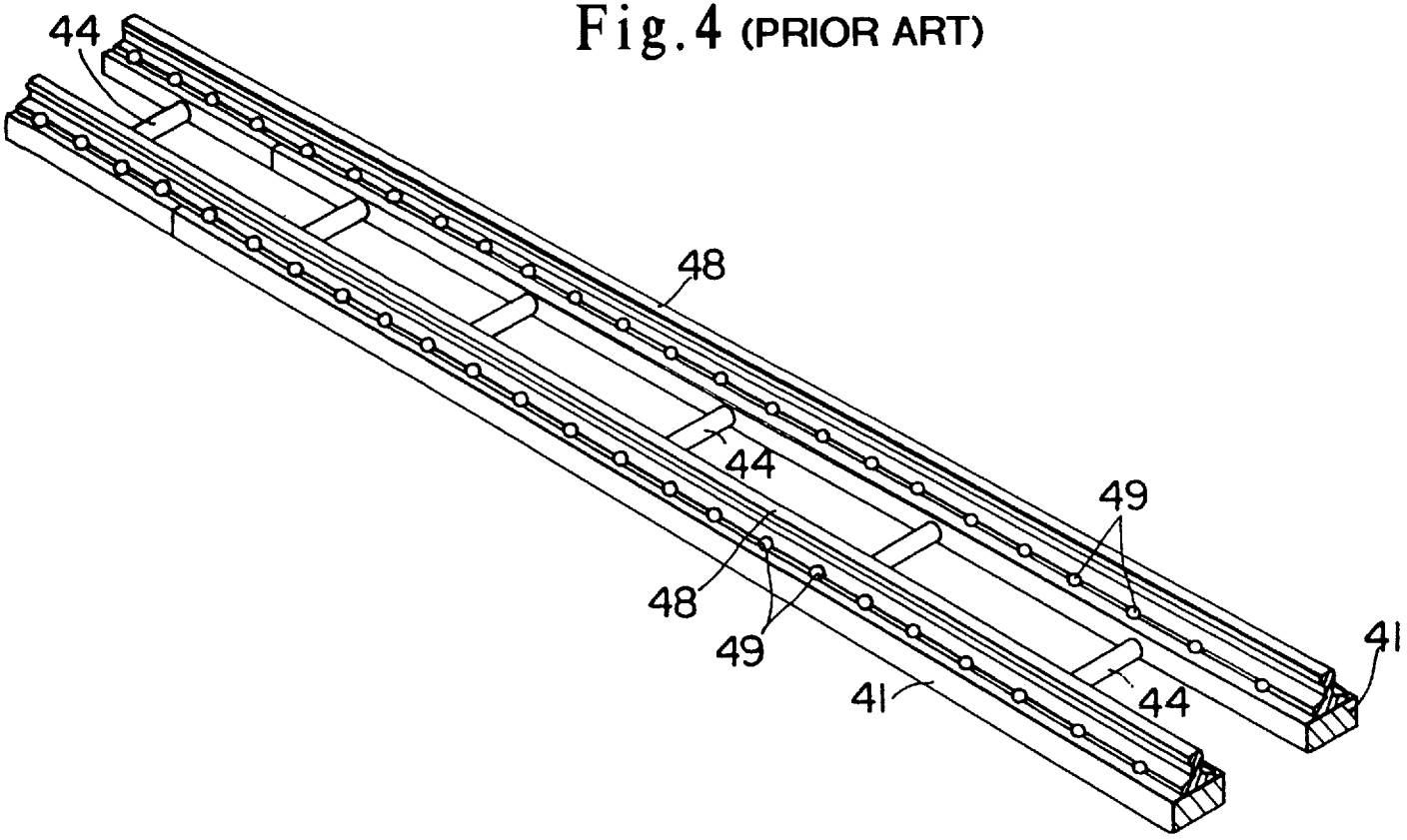
Fig. 4 (PRIOR ART)
FIG. 4 is a perspective view of ladder-type sleepers for railway tracks.
Figure 5:
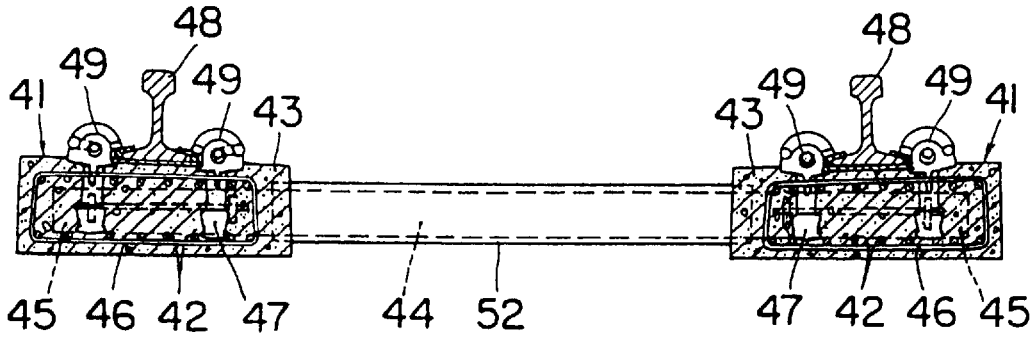
Fig.5 (PRIOR ART)
FIG. 5 is a sectional structural view of a conventional ladder-type sleeper for railway tracks.
Figure 6A:
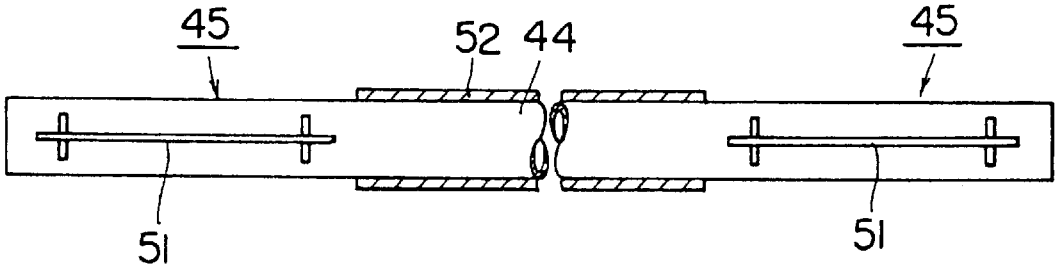
Fig.6(a) (PRIOR ART)
FIGS. 6(*a*) and 6(*b*) illustrate a conventional connector constructed of a steel pipe where FIG. 6(*a*) is a side view omitting a portion of a central portion thereof and FIG. 6(*b*) is a front view of the conventional connector constructed of a steel pipe.
Figure 6B:
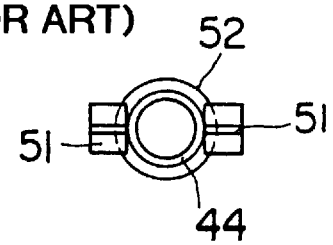
Fig.6(b) (PRIOR ART)

Referring to FIGS. 2(*a*) and 2(*b*), numeral 1 designates a connector constructed of a steel pipe constituted by a thick wall small diameter pipe 6 having flattened portions 2 constructed by flattening both end portions of the pipe such that the thickness of the flattened portion becomes ½ of the outer diameter height in the horizontal direction where a polyethylene coating layer 4 is coated on the outer face of the central portion via a pressure sensitive adhesive 3 for a corrosion resistant coating, a rubber ring 5 is fitted onto the outer face of the polyethylene coating layer 4 and concrete is filled at the inside thereof.

Referring to FIG. 1, numeral 11 designates a ladder-type sleeper for railway tracks using the steel pipe connector 1, which is provided with a mixed rigid connection structure in a ladder-like shape integrated with the longitudinal beams 12 made of concrete and the connectors constructed of steel pipes 1 by feeding concrete. The ladder-type sleeper 11 for railway tracks is provided with a pretension type PRC structure where a plurality of prestressing strands 13 are arranged at the upper and lower portions of the longitudinal beams 12 made of concrete and bearing the sleeper function, stirrups 14 are arranged at the outer peripheries of the prestressing strands 13 at predetermined intervals, rail fasteners 15 are arranged at predetermined intervals, the flattened portions 2 at both end portions of the connector constructed of a steel pipe 1 bearing the tie function, are inserted between the upper and lower prestressing strands 13 such that a distance between rails 16 laid on the ladder-type sleeper 11 for railway tracks becomes a predetermined distance, the longitudinal beams 12 made of concrete and the connector constructed of a steel pipe 1 are solidly integrated by pretensioning the prestressing strands 13 and feeding concrete and the tension of the prestressing strands 13 is released after curing concrete whereby prestress is introduced into the longitudinal beams 12 made of concrete.

By constituting the sleeper as described above, the connector constructed of a steel pipe 1 bearing the tie function of the ladder-type sleeper 11 for railway tracks, is provided with a rigidity necessary for maintaining the rail gauge since it is constituted by the thick wall small diameter steel pipe 6 in which concrete is filled. Further, the connector constructed of a steel pipe 1 is provided with the rotation preventive and drawing preventive function by having the flattened portions 2 in the horizontal direction at the both end portions of the pipe without especially installing ribs at side portions of the both end portions. Further, the polyethylene coating layer 4 excellent in waterproof and insulating performance is provided via the pressure sensitive adhesive 3 at the central portion of the thick wall small diameter steel pipe 6 of the connector constructed of a steel pipe 1 which is not embedded into the longitudinal beams 12 made of concrete and the rubber ring 5 excellent in the weather resistance and the impact resistance is fitted onto the outer face thereof and therefore, the connector constructed of a steel pipe 1 is excellent in the waterproof, the insulating performance, the weather resistance and the impact resistance under environments where it is used, whereby the corrosion resistance of the thick wall small diameter steel pipe 6 can be guaranteed over a long period of time.

Therefore, according to the connector constructed of a steel pipe 1 of the ladder-type sleeper 11 for railway tracks, in comparison with the conventional thick wall small diameter steel pipe 6 where ribs are installed at the side portion of the both end portions of the pipe and the rubber coating by a curing treatment is coated at the central portion, only the polyethylene coating layer 4 is coated at the thick wall small diameter steel pipe 6 and the rubber ring 5 is fitted to the central portion and accordingly, the connector constructed of a steel pipe 1 is inexpensive in view of cost, provided with the sufficient tie function and the rotation preventive and drawing preventive function, as well as provided with the corrosion protection function and the impact resistance for preventing impact defects from causing by a ballast or the like where repair is not necessary over a long period of time.

Embodiment 2

As a connector constructed by a steel pipe for connecting longitudinal beams made of concrete and bearing the tie function of a ladder-type sleeper for railway tracks, there was prepared a conventional example where ribs in an H-type shape having a thickness of 6 mm and a width of 30 mm made of SS 400 of a rolled steel material for general structure prescribed in JIS G3101, were fixedly welded to both side faces by 50 mm through 300 mm from both end portions of a small diameter thick wall steel pipe having an outer diameter of 76.3 mm, a wall thickness of 9.0 mm and a length of 1476 mm made of STK 540 of a carbon steel pipe for general structure prescribed in JIS G3444, a rubber coating was coated at the central portion having a length of 710 mm by a curing treatment and concrete was filled at the inside of the pipe. There was prepared an example of the invention where 300 mm from both end portions of a small diameter thick wall steel pipe having an outer diameter of 76.3 mm, a wall thickness of 9.0 mm and a length of 1476 mm made of STK 540 of a carbon steel pipe for general structure prescribed in JIS G3444, were flattened by pressing such that a thickness of the flattened portion became ½ of the outer diameter, an adhesive agent of ethylene-vinyl acetate copolymer was coated at the central portion having a length of 710 mm by a thickness of 200 $\mu$m, a polyethylene coating was executed by a thickness of 1.5 mm and a urethane rubber ring was fitted onto the outer face of the pipe. Concrete blocks each having a width of 440 mm, an inner thickness of 144 mm, an outer thickness of 155 mm and a depth of 500 mm were fed and cured onto the both end portions of the respective pipes while leaving the central portions of 710 mm and thereafter, fabrication costs and drawing forces from the concrete blocks were measured with respect to the small diameter thick wall steel pipes. The result is shown in Table 1. Incidentally, with regard to the fabrication costs of the respective small diameter thick wall steel pipes, a total of expenses of short pipe cutting, rib cutting, rib tacking, rib welding, readjustment and rubber coating by a curing treatment is assumed as 10 with respect to the conventional example, and with respect to the example of the present invention, a total of expenses of short pipe cutting, press-flattening of both end portions, polyethylene coating and fitting of a urethane rubber ring, is expressed in a proportion to 10 of the conventional example.

TABLE 1

| | Drawing force (Ton) | Fabrication cost |
|---|---|---|
| Conventional Example | 10 or more | 10 |
| Invention Example | 10 or more | 7 |

As shown by Table 1, with respect to the drawing force from the concrete blocks, the invention example is comparable to the conventional example and the fabrication cost of the invention example is reduced to substantially ⅔ of that of the conventional example whereby the cost of the ladder-type sleeper for railway tracks can be reduced by that amount.

According to the connector constructed of a steel pipe of the ladder-type sleeper for railway tracks of the present invention, in comparison with the conventional connector constructed of a steel pipe where ribs are fixedly welded to side faces of the both end portions of a small diameter thick wall steel pipe and a rubber coating by a curing treatment is coated at the central portion, only the both end portions of the small diameter thick wall steel pipe where the polyethylene coating is coated and the rubber ring is fitted onto the outer surface, are flattened by pressing and therefore, the fabrication cost can significantly be reduced and the tie function and the rotation preventive and drawing preventive function are sufficiently provided, which can significantly contribute to reduction in the cost of the ladder-type sleeper for railway tracks.

What is claimed is:

1. A sleeper for use in connecting separated first and second longitudinal concrete beams that support first and second railway tracks, said sleeper being a connector comprising a tubular element having a circular cross-sectional middle portion and opposite first and second flattened end portions, said tubular element being made of steel.

2. A sleeper according to claim 1, wherein said first and second opposite flattened end portions define a thickness which is no greater than ⅞ the diameter of said middle portion.

3. A sleeper according to claim 1, wherein the connector is filled with concrete.

4. A sleeper according to claim 1, including a corrosion-resistant coating around said middle portion.

5. A sleeper according to claim 4, wherein said corrosion-resistant coating is made of a material selected from the group consisting of polyolefin, epoxy, polyurethane, zinc, aluminum, zinc-aluminum and rubber.

6. A sleeper according to claim 4, including an outer rubber tube surrounding said corrosion-resistant coating.

7. A combination of separated first and second longitudinal concrete beams for supporting first and second railway tracks and sleepers connected between said first and second longitudinal concrete beams, each said sleeper comprising a tubular element having a circular cross-sectional middle portion which extends between said first and second longitudinal concrete beams and opposite first and second flattened end portions respectively embedded in said first and second longitudinal concrete beams, each of said first and second flattened end portions extending in a plane which is parallel to said longitudinal beams.

8. A combination according to claim 7, wherein each said sleeper is made of steel and is filled with concrete.

9. A combination according to claim 7, wherein the middle portion is covered with a corrosion resistant coating and an outer rubber tube.

* * * * *